United States Patent [19]

Morishita et al.

[11] Patent Number: 4,553,913

[45] Date of Patent: Nov. 19, 1985

[54] SCROLL-TYPE HYDRAULIC MACHINE

[75] Inventors: Etsuo Morishita; Masahiro Sugihara, both of Hyogo; Tsutomu Inaba, Wakayama; Toshiyuki Nakamura, Wakayama, all of Japan

[73] Assignee: Mitsubishi Denki Kabushiki Kaisha, Tokyo, Japan

[21] Appl. No.: 607,917

[22] Filed: May 7, 1984

[30] Foreign Application Priority Data

Jul. 1, 1983 [JP] Japan ..... 58-120608

[51] Int. Cl.[4] ..... F03C 2/02; F04C 2/04; F04C 11/00

[52] U.S. Cl. ..... 418/55; 418/60; 418/88

[58] Field of Search ..... 418/55, 58, 60, 88

[56] References Cited

U.S. PATENT DOCUMENTS

| | | | |
|---|---|---|---|
| 3,407,996 | 10/1968 | Olofsson et al. | 418/88 |
| 3,986,799 | 10/1976 | McCullough | 418/88 |
| 4,065,279 | 12/1977 | McCullough | 418/55 |
| 4,431,388 | 2/1984 | Eber et al. | 418/55 |

FOREIGN PATENT DOCUMENTS

| | | | |
|---|---|---|---|
| 57-38690 | 3/1982 | Japan | 418/55 |

*Primary Examiner*—John J. Vrablik

*Attorney, Agent, or Firm*—Sughrue, Mion, Zinn, Macpeak, and Seas

[57] ABSTRACT

A scroll-type hydraulic machine having a first stationary scroll with a first scroll wrap, a first orbiting scroll with a second scroll wrap on one surface thereof interleaved with the first scroll wrap, a first orbiting scroll shaft on the other surface of the first orbiting scroll, a second stationary scroll having a third scroll wrap, a second orbiting scroll having a fourth scroll wrap on one surface interleaved with the third scroll wrap, a second orbiting scroll shaft provided on the other surface of the second orbiting scroll, and a crank mechanism. The crank mechanism includes a rotatably driven crankshaft having an eccentric through-hole extending lengthwise therethrough, an eccentric shaft rotatably supported by bearings in the eccentric through-hole, and first and second eccentric ring mechanisms. Each eccentric ring mechanism is provided at one end of the eccentric shaft and is rotatable with respect thereto. The orbiting scroll shafts are driven in an orbital pattern through the respective eccentric ring mechanisms.

18 Claims, 16 Drawing Figures

SCROLL-TYPE HYDRAULIC MACHINE

BACKGROUND OF THE INVENTION

The present invention relates to a scroll-type hydraulic machine.

Before describing the present invention, the basic principles of a scroll-type hydraulic machine will be briefly explained.

FIGS. 1A to 1D show fundamental components of a scroll-type compressor, which is one application of a scroll-type hydraulic machine, and the operations thereof in successive angular positions. In these figures, the compressor is composed of a stationary scroll 1, having a fixed center O, and an orbiting scroll 2, which performs an orbiting motion around a fixed point O'. Compression chambers 4 are formed between the stationary scroll 1 and the orbiting scroll 2, and a discharge port 3 is formed around a center portion of the stationary scroll 1. The scrolls 1 and 2 take the form of spiral arms, each of which may be in the form of an involute or a combination of involutes and arcs. The arms are complementary in shape. The stationary scroll 1 and the orbiting scroll 2 are interleaved as shown.

In operation, the orbiting scroll 2 orbits continuously with respect to the stationary scroll 1 from a starting position (0°) shown in FIG. 1A through operating cycle phase positions of 90° (FIG. 1B), 180° (FIG. 1C) and 270° (FIG. 1D), without changing its angular orientation with respect to the stationary scroll 1. With such orbital movement of the orbiting scroll 2, the volumes of the compression chambers 4 are cyclically reduced, and thus fluid introduced therein is compressed. The compressed fluid is finally discharged from the discharge port 3. During this operation the distance between the center O and the fixed point O', which is maintained constant, can be represented by:

$$OO' = \frac{p}{2} - t,$$

where p corresponds to a distance between wraps and t is the wall thickness of each wrap.

In order to minimize the thrust force of a scroll-type hydraulic machine or compressor having a large capacity, a structure has been proposed in which the orbiting scrolls are arranged in a back-to-back relationship to cancel out the thrust forces. Examples of such structures are disclosed in U.S. Pat. Nos. 801,182, 3,011,694 and 4,192,152. In order to facilitate an understanding of the background of the present invention, the structure having the back-to-back arranged orbiting scrolls will be described briefly with reference to FIG. 2, which shows schematically an example of such a structure as disclosed in U.S. Pat. No. 4,192,152.

In FIG. 2, a pair of stationary scrolls 1 have complementary-shaped wraps 5. The scrolls 1 are fixedly secured to each other by bolts 4 with the scroll wraps facing one another with a space therebetween. An orbiting scroll 2 is provided on opposite surfaces of a center plate with complementary-shaped orbiting scroll wraps 6. The orbiting scroll 2 is disposed in the space between the stationary scrolls forming a plurality of compression chambers 4 between the stationary scroll wraps 5 and the orbiting scroll wraps 6. Discharge ports 3 for the compressed fluid are formed at center portions of the stationary scrolls 1 to which respective discharge tubes 15 are connected. An intake port 16 is formed at a suitable peripheral position of one of the stationary scrolls 1 to which an intake pipe 17 is connected. Near the intake port 16 in the space between the stationary scrolls 1 is formed a suction chamber 18. A crankshaft 7 having an eccentric portion is supported by bearings 9, 10 and 11 provided in the stationary scrolls 1 and is driven through a coupling 12 by a drive source 13. The eccentric portion of the crankshaft 7 is supported by a bearing 8 provided in the orbiting scroll 2. A balance weight 19 is attached to the eccentric portion of the crankshaft 7 to balance a centrifugal force acting on the orbiting scroll 2 during the operation of the machine.

In operation, the crankshaft 7 is rotated by the drive source 13, which may be electric motor, internal combustion engine, turbine or the like. Upon the rotation of the crankshaft 7, an orbiting force is imparted to the orbiting scroll 2 via the bearing 8 by the eccentric rotation of the eccentric portion of the crankshaft. Compression then occurs on both sides of the orbiting scroll as described above. The pressure in the compression chambers 4 increases as the chambers 4 move towards the center portion of the machine and pressurized fluid is discharged through the discharge ports 3 and hence through the discharge tubes 15. At the same time, fluid intake occurs through the suction tube 17 and the intake port 16 to the intake chamber 18, which feeds the fluid to the compression chamber 4. The centrifugal force acting on the orbiting scroll 2 which is generated during the operation thereof is statically as well as dynamically balanced by the balance weight 19 shown in FIG. 2.

Since the compression chambers 4 are formed symmetrically around the orbiting scroll 2, the pressure distribution of the compression chambers 4 on both sides of the orbiting scroll 2 are similar, and thus there are no thrust forces acting on the orbiting scroll 2 as a whole. This construction is particularly effective when the operating speed of the orbiting scroll is low and the thrust load is large because, in such a case, it is very difficult to use a thrust bearing.

Although this conventional structure is advantageous due to the fact that no thrust force is produced, there are still problems in actual practice. Specifically, it is impossible as a practical matter to manufacture the orbiting scroll 2 having the complementary scroll wraps 6 on the opposite sides thereof with a high precision, and it is very difficult to assemble the orbiting scroll with the stationary scroll 1 with precisely controlled radial gaps between the orbiting scroll wraps 6 and the stationary scroll wraps 5 on both sides of the orbiting scroll. Particularly, the relative position of one stationary scroll to the other is determined by the relative positions of the bearings mounted in the stationary scrolls 1, and the relative position of the orbiting scroll 2 to the stationary scrolls 1 is determined by the coupling provided by the crankshaft 7. Thus, very precise adjustment of the radial gaps between the orbiting scroll and the stationary scrolls is impossible as a practical matter. Once these factors are taken into account, the conventional scroll-type machine constructed as described above has not been entirely satisfactory.

Another important problem relates to the driving system for the orbiting scroll. In FIG. 2, a single crank mechanism is used. In a case where a plurality of crank mechanisms are arranged equiangularly, the eccentric centers of the respective crankshafts 7 of the mechanisms must be highly precisely determined, otherwise a normal operation of the machine itself cannot be expected.

A more important problem resides in that, due to the fact that the drive system is disposed at the periphery of the orbiting scroll 2, the diameter of the orbiting scroll 2 is necessarily large, and due to a large mass resulting from such a large diameter of the orbiting scroll, the bearing load due to centrifugal forces is not negligible. Furthermore, the diameter of the stationary scrolls 1 is necessarily also large, which makes it necessary to make the walls of the stationary scrolls quite thick.

SUMMARY OF THE INVENTION

Overcoming these drawbacks, the present invention provides a scroll-type hydraulic machine having a pair of stationary scroll wraps and orbiting scroll wraps assembled together in which thrust loads acting on the orbiting scroll are cancelled by constructing the machine so that the thrust forces act on opposite sides of the eccentric shaft. Further in accordance with the invention, the mechanical reliability of the machine is improved by minimizing the relative movement between the orbiting scroll and the eccentric shaft.

Furthermore, the invention provides a scroll-type hydraulic machine having orbiting scrolls which are easily assembled with the stationary scrolls and the gaps between the orbiting scrolls and the stationary scrolls are easily sealed.

More specifically, the present invention, provides a scroll-type hydraulic machine including a first stationary scroll having a first scroll wrap, a first orbiting scroll having a second scroll wrap interleaved with the first scroll wrap such that the interleaved first and second scroll wraps compress and discharge introduced fluid when the second scroll wrap is orbited with respect to the first scroll wrap; a first orbiting scroll shaft provided on the orbiting scroll opposite the second scroll wrap, a second stationary scroll having a third scroll wrap, a second orbiting scroll having a fourth scroll wrap interleaved with the third scroll wrap such that the interleaved third and fourth scroll wraps compress and discharge introduced fluid when the fourth scroll wrap is orbited with respect to the third scroll wrap, a second orbiting scroll shaft provided on the second orbiting scroll opposite the fourth scroll wrap, and a crank mechanism. The crank mechanism includes a crankshaft having an eccentric through-hole and which is rotated by driving means, an eccentric shaft supported in the eccentric through-hole of the crankshaft through bearings, a first driven eccentric ring mechanism, and a second driven eccentric ring mechanism. The first orbiting scroll shaft is disposed at one end of the eccentric shaft and is engaged therewith through the first driven eccentric ring mechanism rotatable with respect to the eccentric shaft to orbit the first orbiting scroll shaft. Similarly, the second orbiting scroll shaft is disposed at the other end of the eccentric shaft and is engaged therewith through the second driven eccentric ring mechanism rotatable with respect to the eccentric shaft. The crank mechanism further includes a pair of discrete, driven eccentric ring mechanisms, disposed on opposite sides of the eccentric shaft, through which the orbiting scroll shafts are driven.

DESCRIPTION OF THE PREFERRED EMBODIMENTS

Figure 3:
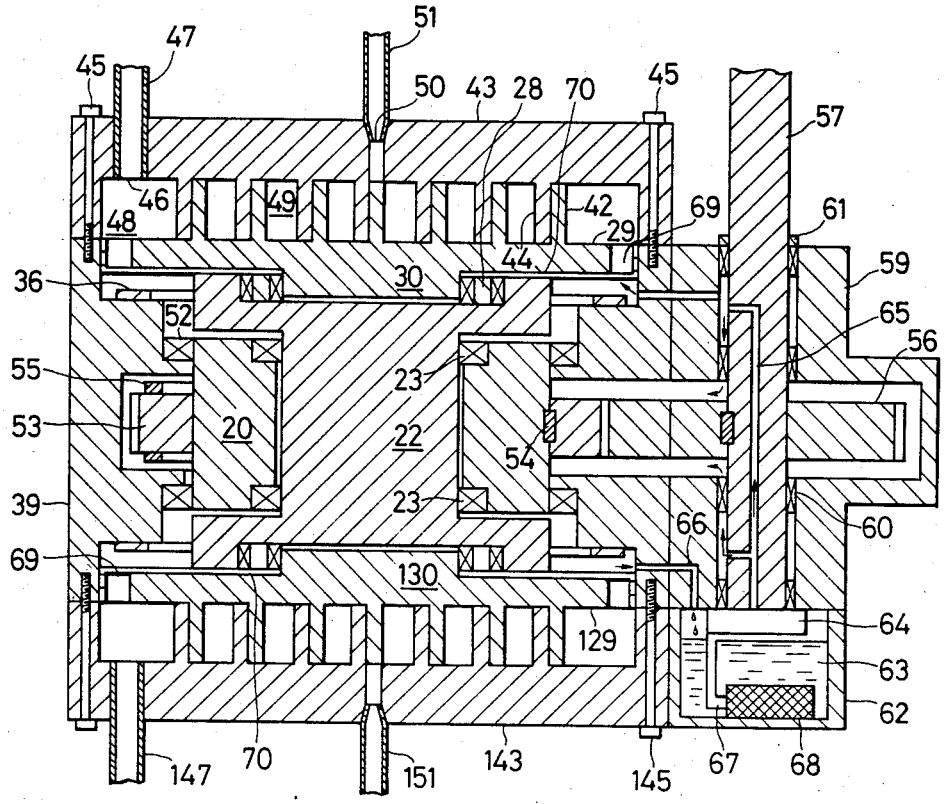
FIG. 3 is a cross-sectional view of a scroll-type hydraulic machine constructed according to the present invention.
Figure 4:
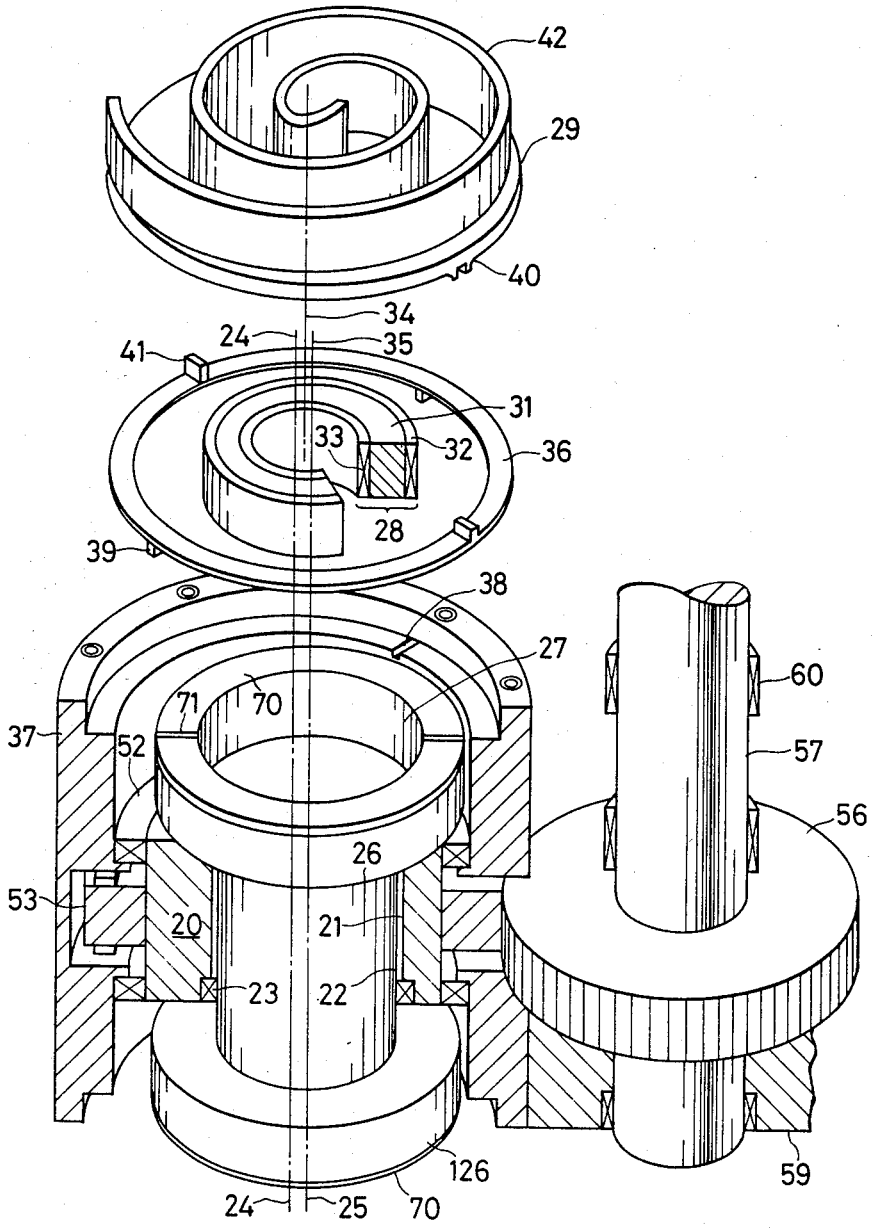
FIG. 4 is an enlarged view of a portion of the machine of FIG. 3 in a disassembled state.
Figure 5A:
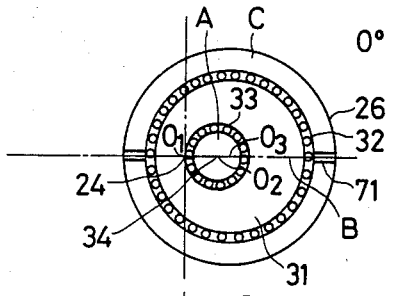
FIGS. 5A–5D through 7 illustrate a driven eccentric ring mechanism in successive operational positions.

In FIG. 3, which is a cross-sectional view of a preferred embodiment of a scroll-type hydraulic machine according to the present invention, and in FIG. 4, which is an enlarged perspective view of a portion of the machine of FIG. 3 in a disassembled state with important portions exaggerated, a crankshaft 20 is provided with an eccentric through-hole 21 in which an eccentric shaft 22 is rotatably supported through bearings 23. The crankshaft 20, the bearing 23, the eccentric shaft 22, and the driven eccentric ring mechanisms constitute a crank mechanism. The crankshaft 20 and the eccentric shaft 22 have rotational centers 24 and 25 (FIG. 4), respectively. The eccentric shaft 22 has at one end thereof an enlarged portion 26 formed with a center recess 27 in which a driven eccentric ring mechanism 28 is rotatably received. An orbiting scroll shaft 30 of an orbiting scroll 29 is rotatably fitted in the driven eccentric ring mechanism 28. The driven eccentric ring mechanism 28 is composed of an eccentric ring 31, an eccentric ring bearing 32 supporting the eccentric ring 31 rotatably with respect to the enlarged portion 26 of the eccentric shaft 22, and an orbiting scroll bearing 33 supporting the eccentric ring 31 rotatably with respect to the orbiting scroll shaft 30. The orbiting scroll shaft 30 has a center of rotation $O_2$ (34) separated from the center of rotation $O_1$ (24) of the crankshaft 20 by a predetermined crank radius r (see also FIG. 5A). The eccentric ring 31 has a center of rotation $O_3$ (35) which lies at a point substantially on a straight line connecting the center of rotation 24 and the center of rotation 34 of the orbiting scroll shaft 30 and on an opposite side to the center of rotation 24 with respect to the point 34. The positions of the points $O_1$, $O_2$ and $O_3$ are shown in FIG. 5A and will be described in more detail later. In this embodiment, the center 25 of the eccentric shaft 22 coincides with the center 35 of the eccentric ring 31.

An Oldham coupling 36 (FIG. 4) of a known construction is used to maintain the angular position of the orbiting scroll 29. The Oldham coupling 36 includes a ring member, a pair of lower protrusions 39 formed opposite each other on a lower surface of the ring member, and a pair of upper protrusions 41 formed opposite each other and orthogonally to the lower protrusions on the upper surface of the ring member. The protrusions 39 are slidably engaged with an Oldham coupling groove 38 formed on a housing 37, and the protrusions 41 are slidably engaged with an Oldham coupling claw 40 formed on the orbiting scroll 29. The scroll 29 has on a lower surface thereof a shaft 30 and on an upper surface thereof an orbiting scroll wrap 42 interleaved with a wrap 44 of a stationary scroll 43. Scroll 43 is fastened by bolts 45 to the housing 37. The wraps establish an angular relationship as shown in FIG. 1.

An intake port 46 is formed in the stationary scroll 43 to which an inlet pipe 47 is connected. When the orbiting scroll 29 orbits with respect to the stationary scroll 43, the fluid to be compressed is sucked through the intake pipe 47 to a suction chamber 48 and, after being compressed in the compression chambers 49, is discharged via a discharge port 50 through the discharge pipe 51.

The crankshaft 20 is supported by crankshaft bearings 52 provided in the housing 37. A driven gear mechanism 53 is keyed to the outer periphery of the crankshaft 20 to drive the latter. A balance weight 55 is attached to the driven gear mechanism 53 to balance the centrifugal force produced by the operation of the machine and acting on the orbiting scroll.

The other end of the eccentric shaft 22 is formed with an enlarged diameter portion 126 which is similar to the upper enlarged portion 26 and has a center recess similar to the recess 27 of the upper enlarged diameter portion 26. The enlarged diameter portion 126 is coupled with a shaft 130 of a lower orbiting scroll 129. Housing 37 and scroll 129 are coupled through an Oldham coupling similar to that associated with the upper obiting scroll 29 but having a complementary configuration.

The driven gear mechanism 53 is driven by a driving gear 56 keyed to a drive shaft 57. A gear box 59 houses a plurality of drive shaft bearings 60 by which the drive shaft 57 is rotatably supported. A hole through which the drive shaft 57 extends outwardly is provided with a sealing member 61 with which the gear box is sealed and is prevented from being contaminated by dust.

Figure 1A:
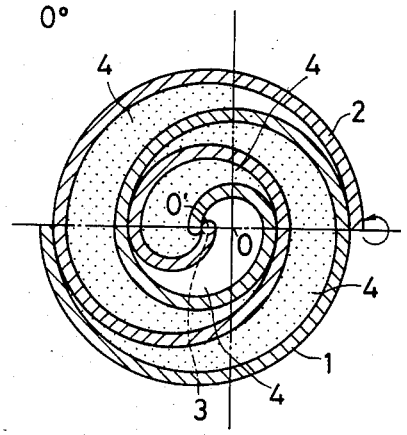
FIG. 1A PRIOR ART
FIGS. 1A to 1D are cross-sectional views showing a scroll-type hydraulic machine in successive operational steps used for an explanation of the operating principles thereof.
Figure 1D:
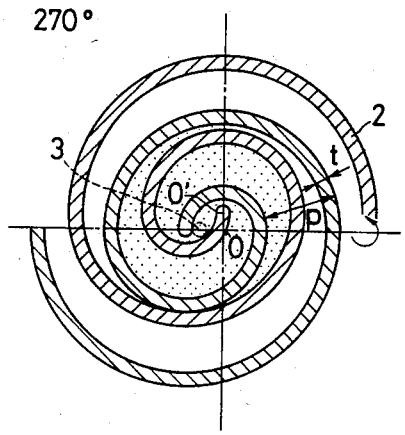
FIG. 1D PRIOR ART
Figure 1B:
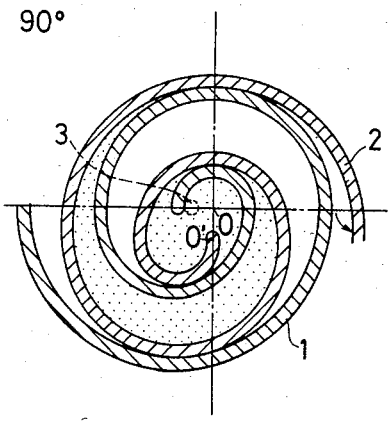
FIG. 1B PRIOR ART
Figure 1C:
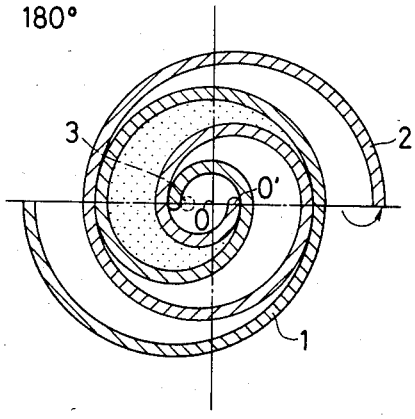
FIG. 1C PRIOR ART
Figure 2:
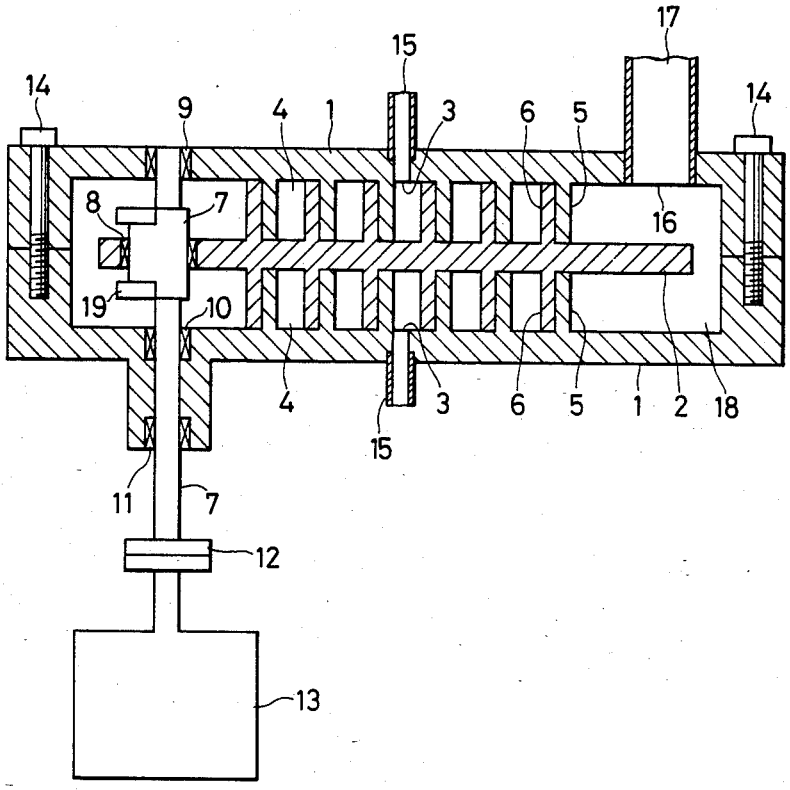
FIG. 2 PRIOR ART
FIG. 2 is a cross-sectional view of a conventional scroll-type hydraulic machine.

A lubricating oil tank 62 is provided below the gear box 59 and a pump 64 is incorporated therein. The pump 64, when operated, feeds lubricating oil 63 from the tank 62 through an oil supply hole 65 to lubricate the drive shaft bearings 60. The oil then passes to the housing 37. After lubricating the various sliding portions including bearings in the housing 37, the oil is returned through an oil return hole 66 to the tank 62 as indicated by arrows in FIG. 2. In order to protect the pump 64, a filter 68 is provided at an inlet portion of an intake pipe 67 of the pump 64. Members depicted by reference numerals 69 (FIG. 3), 70 (FIG. 4) and 71 (FIG. 4) are oil throwers, thrust bearings and oil supply grooves, respectively.

In operation, the scroll-type hydraulic machine, here assumed to be a compressor, starts when the drive shaft 57 is driven by a driving source such as an electric motor, internal combustion engine, turbine, etc. (not shown). When the drive shaft 57 rotates, the driving gear 56 engaged with the drive shaft 57 is rotated to rotate the driven gear 53 meshed with the driving gear 56. Since the driven gear 53 is coupled to the crankshaft 20, the latter, which is supported by the crankshaft bearings 62 in the housing 37, also rotates about its center 24.

The eccentric shaft 22, having the center 25 and supported by the bearings 23 in the eccentric through-hole 21 of the crankshaft 20, is rotated about the center of rotation 24 with the distance corresponding to the crank radius r being maintained between the center 25 and the center of rotation 24.

As mentioned previously, the enlarged diameter portions 26 and 126 provided at the opposite ends of the eccentric shaft 22 and associated components are similar but complementary in shape. Therefore, only the enlarged diameter portion 26 and the elements associated therewith will be described in detail. The circular recess 27 formed in the enlarged diameter portion, having the center of rotation 25, rotatably receives therein the driven eccentric ring mechanism 28. The driven eccentric ring mechanism 28 functions to seal the radial gap between the stationary scroll wrap 44 of the stationary scroll 43 and the orbiting scroll wrap 42 of the orbiting scroll 29 during the operation of the machine. The operating principles thereof will be described with reference to FIGS. 5A through 7.

Figure 5B:
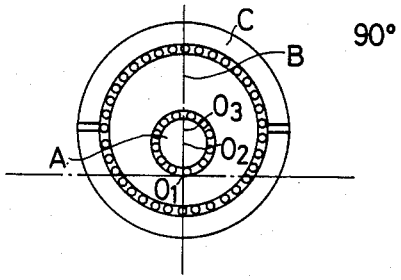
Figure 5C:
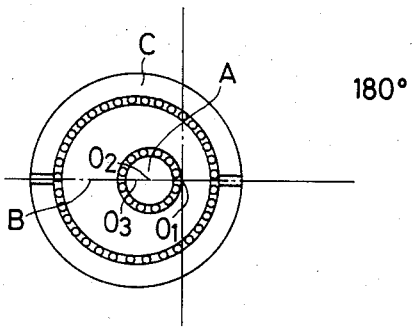
Figure 5D:
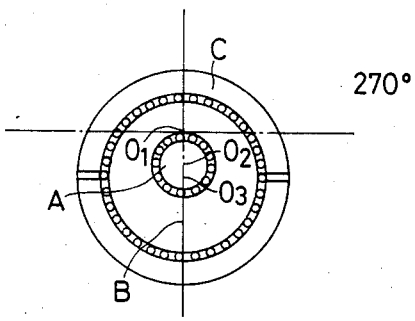

In FIGS. 5A through 5D, the center of rotation $O_1$ (24) of the crankshaft 20 is assumed to be at the origin of the indicated coordinate system. A, B and C indicate fixed points on the orbiting scroll shaft 30, the eccentric ring 31, and the enlarged diameter portion 56, respectively. FIGS. 5A through 5D illustrate relative positions of these elements when the machine is at operating cycle phase angles of 0°, 90°, 180° and 270°, respectively. When the crankshaft 20 rotates around the center of rotation $O_1$, the center $O_3$ of the eccentric shaft 22 also rotates around the center of rotation $O_1$. Therefore, the center $O_2$ of the orbiting scroll shaft 30 rotates around $O_1$ with $O_1O_2=r$. Thus $O_1$, $O_2$ and $O_3$ are arranged substantially on a straight line which rotates at the same rotational speed as the crankshaft 20. At this time, the point A on the orbiting scroll shaft 30 does not perform rotation relative to the center $O_2$ due to the restriction imposed by the Oldham coupling 36, and lines connecting the center $O_2$ to the point A in the respective states shown in FIGS. 5B, 5C and 5D are always parallel to the line between the center $O_2$ and the point A in the state shown in FIG. 5A.

As to the fixed point C on the thrust bearing 70 and hence the increased diameter portion 26, there is a slight relative movement between the thrust bearing 70 and the orbiting scroll 29. Therefore, the point C tends to rotate about $O_3$ with a rotational radius of $O_2O_3$. However, since, as will be described later, the distance $O_1O_2$ increases when the point C rotates in either direction, the wrap 42 of the orbiting scroll 29 contacts the wrap 44 of the stationary scroll 43. Therefore, the range of movement of the center of rotation $O_2$ is on the order of the width of the gap between the wraps 44 and 42, and thus the range of relative movement between the center $O_3$ and the point C is of the same order as above. Thus, a line connecting the center $O_3$ and the point C is substantially parallel to that shown in FIG. 5A through the entire rotational cycle, as shown in FIGS. 5A through 5D. Accordingly, the fixed point B on the eccentric ring 31 always falls on a line connecting the centers $O_1$, $O_2$ and $O_3$ and performs relative movement with respect to $O_2$. As will be clear from the foregoing, since the eccentric ring 31 undergoes movement relative to the orbiting scroll shaft 30 and the increased diameter portion 26 and hence the eccentric shaft 22, the orbiting scroll bearing 33 and the eccentric ring bearing 32 are provided.

The relative movement between the thrust bearing 70 and the orbiting scroll 29 is a circular movement with a radius $O_2O_3$ and, if $O_2O_3=e$ is made small enough, it is possible to make the relative speed quite small.

Figure 6:
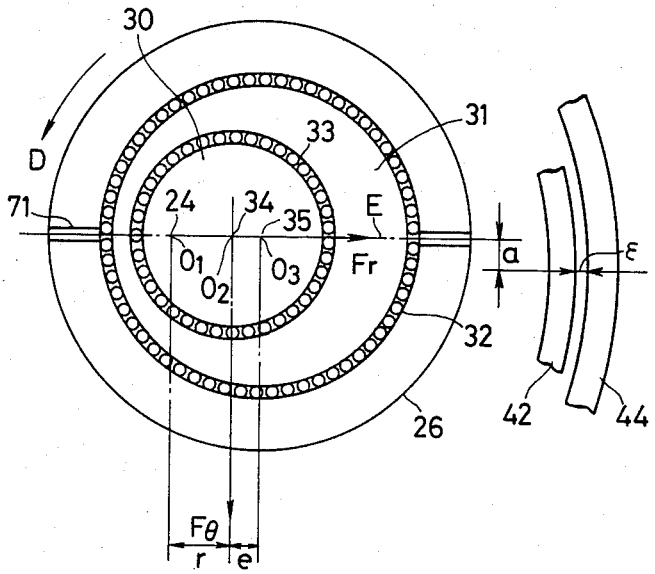
Figure 7:
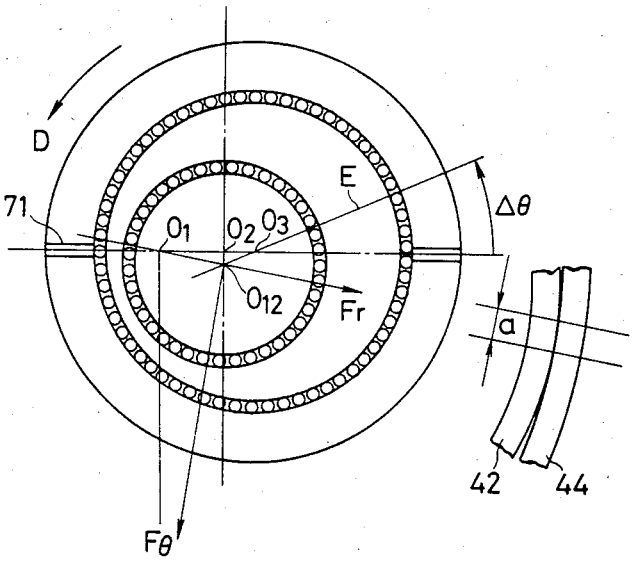

The way in which radial sealing of the driven eccentric ring mechanism 28 is achieved will now be described with reference to FIGS. 6 and 7. It has been well known that when the compression operation is started, a force $F_\theta$, which is tangential to the rotational direction D, and a radial force $F_r$, due mainly to the centrifugal force of the orbiting scroll 29, act on the center of rotation $O_2$ of the orbiting scroll shaft 30, and hence produce a load on the driving source. This is shown in FIG. 6. When the force component $F_\theta$ acts on the center of rotation $O_2$, a moment $F_\theta \cdot e$ is produced around the center of rotation $O_3$ of the eccentric ring 31. At this time, since the force component $F_r$ acts on a straight line connecting the centers $O_2$ and $O_3$, there is no moment produced around $O_3$. In some cases, there may be a minute gap $\epsilon$ present between the wraps 44 and 42 of the stationary scroll 43 and the orbiting scroll 29, even if the distance between the centers $O_1$ and $O_2$ is maintained at the predetermined crank radius $$r = \frac{p}{2} - t.$$

Further, it has been empirically determined that the width of such gap is on the order of several microns to several tens of microns. It has been also known that if the wraps 44 and 42 are shaped as involutes of a circle having radius a, the gaps $\epsilon$ fall along straight lines which are parallel to each other and symmetric about the vector force component $F_r$ and spaced a distance a therefrom.

When the moment $F_\theta \cdot e$ acts about the center of rotation $O_3$ of the eccentric ring as described, the center of rotation $O_2$ of the orbiting scroll shaft 30 tends to rotate around $O_3$ and the wrap 42 of the orbiting scroll 29 approaches the wrap 44 of the stationary scroll until the minute gap $\epsilon$ disappears. This state is shown in FIG. 7. The center of rotation $O_2$ of the orbiting scroll shaft 30 rotates about the center $O_3$ through a minute angle $\Delta\theta$ and reaches a point $O_{12}$. At this time, the distance between $O_1$ and $O_2$ increases to be the same as that between the points $O_1$ and $O_{12}$, causing the minute radial gap $\epsilon$ to disappear. As shown in FIG. 7, a sealing force f is thus produced between the wraps 44 and 42, and hence the distance e between $O_2$ and $O_3$ can be obtained from the equation representing the balance of moments, namely, $2f \cdot a = F_\theta \cdot e$, where $\epsilon$ and hence the angle $\Delta\theta$, are assumed as being negligible. From this, the sealing force f can be calculated as $$f = \frac{e}{2a} \cdot F_\theta.$$

Accordingly, it can be understood that sealing of the radial gap between the scroll wraps 44 and 42 is realized and leakage of compressed fluid therethrough during the operation of the machine is hence minimized.

A specific feature of the driven eccentric ring mechanism 28 is that the sealing force f is a function of only the tangential force component $F_\theta$, which is a function only of the pressure in the compressor, and is not substantially influenced by the speed (r.p.m.) of the machine. In this manner, the driven eccentric ring mechanism 28, received in the circular recess 27 of the eccentric shaft 22, seals the radial gap between the stationary scroll wrap 44 and the orbiting scroll wrap 42.

When the eccentric shaft 22 is driven by the crankshaft 20, the orbiting scroll 29 is driven through the driven eccentric crank mechanism 28. In order to perform compression according to the principles illustrated in FIGS. 1A through 1B, the Oldham coupling 36 engages with the Oldham coupling grooves 38 formed on the housing 37 and with the Oldham coupling claws 31 of the orbiting scroll 29. The Oldham coupling 36 performs a straight reciprocal movement with respect to the housing 37 and also performs a relative straight reciprocal movement with respect to the orbiting scroll 29 (see FIG. 4).

Figure 8:
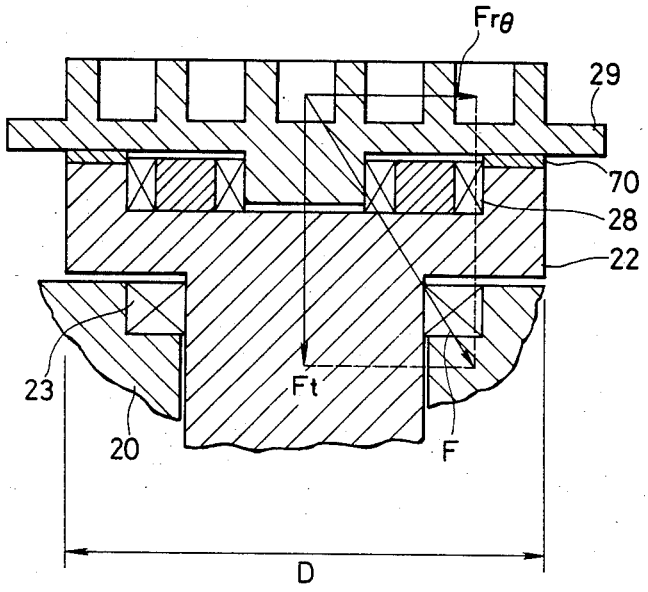
FIG. 8 illustrates forces acting on the orbiting scroll.

When the orbiting scroll 29 is driven by the eccentric shaft 22 through the driven eccentric ring mechanism 28 and the Oldham coupling 36, the compression of fluid occurs according to the principles illustrated by FIGS. 1A through 1D and the force F is exerted on the orbiting scroll 29 as shown in FIG. 8. In FIG. 8, a component $F_t$ of the force F is the thrust load (axial load), and a component $F_{r\theta}$ is the radial load. As is clear from FIG. 7, the radial load $F_{r\theta}$ is a composite force of the tangential force $F_\theta$ and the radial force $F_r$, and hence can be represented by $$F_{r\theta} = \sqrt{F_r^2 + F_\theta^2}.$$

As shown in FIG. 5, the relative movement of the point A on the orbiting scroll shaft 30 to the point C on the eccentric shaft 22 is small, and thus the thrust bearings 70 provided in the orbiting scroll 29 and the eccentric shaft 22 undergo only a very small relative movement. In more detail, the circular movement has a radius equal to the distance e between $O_2$ and $O_3$; the smaller the distance e, the smaller the amount of relative movement. Further, there is a relative movement caused by the driven eccentric ring mechanism 28 when rotated through the minute angle $\Delta\theta$ indicated in FIG. 7. However, this relative movement is very small, and thus the relative movements of the orbiting scroll 29 and the eccentric shaft 22 are very small. Therefore, the thrust force $F_t$ indicated in FIG. 8 is transmitted through the outer periphery of the lower surface of the orbiting scroll 29 to the thrust bearing 70 of the eccentric shaft 22. The small relative movement between the outer periphery of the lower surface of the orbiting scroll 29 and the thrust bearing 70 as mentioned above is one of the important features of the present invention. Further, since the eccentric shaft 22 is provided at the opposed ends thereof with complementarily configured structures including the stationary scroll and the orbiting scroll, the thrust forces $F_t$ acting on the orbiting scrolls 29 and 120 cancel one another and no force is exerted on the eccentric shaft 22 (see FIG. 3).

In order to dynamically stabilize the orbiting scroll 29, as shown in FIG. 8, the vector of the composite force F must be inside the outer diameter of the thrust bearing 70. In order to achieve this, the outer diameter D of the thrust bearing 70 should be as close as possible to the outer diameter of the orbiting scroll 29.

When the orbiting scroll 29 operates stably as shown in FIG. 8, gas to be compressed is introduced through the intake pipe 47 connected to the intake port 46 to the suction chamber 48 and then to the compression chambers 49 where it is compressed. After being compressed, it is discharged through the discharge port 50 and the discharge pipe 51, at which point the compression cycle is complete.

Lubricating oil 63 is sucked by the pump 64 through the filter 68 and the suction pipe 67 and supplied through the oil supply port 66 to the various sliding components of the machine. The lubricating oil, after lubricating the sliding components within the housing 37, is returned through the return oil port 45 formed in the gear box 59 to the oil tank 62. The oil throwers 69 provided in the housing 37 function to prevent excess amounts of lubricating oil from being fed to the suction chamber 48.

Although, in the above described embodiment, the crankshaft 20 is driven through a gearing arrangement, it is possible to drive the crankshaft 20 directly from an electric motor mounted in the housing of the compressor. That is, instead of the driven gears 53, the rotor of the electric motor is arranged in the same location and the stator is secured to the housing 37. Upon supplying electric power to the motor, the rotor rotates the crankshaft to perform the compression operation. In such case, it may be possible to make the compressor itself smaller because the motor is provided in the housing.

Figure 9:
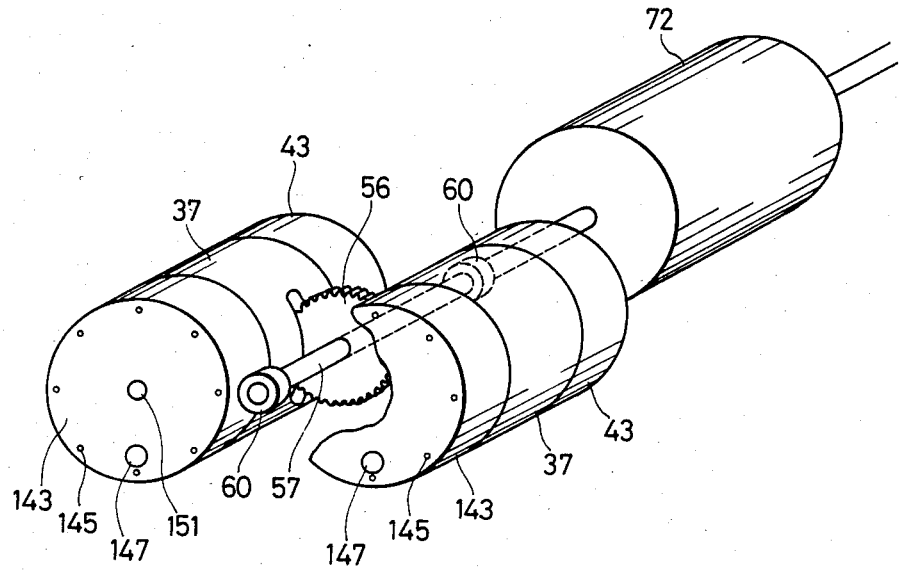
FIG. 9 is a perspective view of a large-scale version of the preferred embodiment of the present invention.
Figure 10:
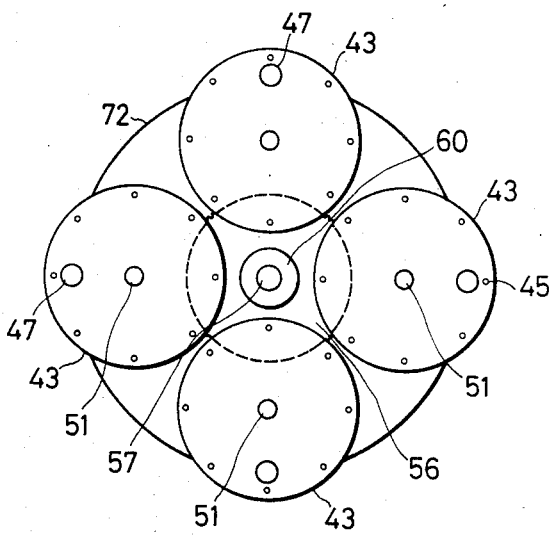
FIG. 10 is a front view of the machine of FIG. 9.

FIGS. 9 and 10 show two respective further embodiments of the present invention, each of which is composed of a plurality of hydraulic machines, each having a stationary scroll and an orbiting scroll arranged relative to the crankshaft as shown in FIG. 3 to thereby increase the capacity of the scroll-type hydraulic machine. In FIG. 9, a pair of machine units are arranged around the driving gear 56 equiangularly and simultaneously driven by the driving gear 56, which is in turn driven by the driving source 72. In FIG. 10, four machine units are arranged around the driving gear 56 equiangularly and driven simultaneously by the driving gear 56.

It is possible to further increase the capacity of the hydraulic machine by mounting a plurality of driving gears 56 on the driving shaft 57 and driving plural machine units with each of them. Alternatively, it is possible to increase the capacity by providing driving shafts 57 on both sides of the driving source 72 and providing a driving gear 56 on each of the driving shafts.

As described in detail hereinbefore, the present invention provides a scroll-type hydraulic machine in which the thrust forces $F_t$ acting on the orbiting scrolls act on opposite sides of the eccentric shaft and to thus cancel one another. Further, the relative movement between the orbiting scroll and the eccentric shaft is minimized, resulting in an improvement of the mechanical reliability of the hydraulic machine. Furthermore, since the orbiting scrolls are arranged at the opposed ends of the eccentric shaft and driven individually through respective driven eccentric ring mechanisms, the orbiting scroll can be easily assembled with the stationary scroll. Also, good sealing of the radial gap between the orbiting scroll and the stationary scroll is obtained.

We claim:

1. A scroll-type hydraulic machine, comprising:

A. a first stationary scroll having a first scroll wrap;

B. a first orbiting scroll having on one surface thereof a second scroll wrap, said second scroll wrap being interleaved with said first scroll wrap so that, when said second scroll wrap orbits with respect to said first scroll wrap, fluid introduced between said scroll wraps is changed in volume;

C. a first orbiting scroll shaft provided on the other surface of said first orbiting scroll;

D. a second stationary scroll having a third scroll wrap;

E. a second orbiting scroll having on one surface thereof a fourth scroll wrap, said fourth scroll wrap being interleaved with said third scroll wrap so that when said fourth scroll wrap orbits with respect to said third scroll wrap, fluid introduced between said third and fourth scroll wraps is changed in volume;

F. a second orbiting scroll shaft provided on the other surface of said second orbiting scroll; and G. a crank mechanism, said crank mechanism comprising:

(1) a rotatably driven crankshaft having an eccentric through-hole extending lengthwise therethrough, (2) a plurality of bearings provided in said eccentric through-hole, (3) an eccentric shaft rotatably supported by said bearings in said eccentric through-hole, (4) a first eccentric ring mechanism provided at one end of said eccentric shaft and rotatable with respect thereto, said first orbiting scroll shaft being orbitally driven through said first eccentric ring mechanism, and (5) a second eccentric ring mechanism provided at the other end of said eccentric shaft and rotatable with respect thereto independently of said first eccentric ring mechanism, said second orbiting scroll shaft being orbitally driven through said second eccentric ring mechanism, said first and second eccentric ring mechanisms each comprising a ring having an eccentrically formed opening therein for the respective scroll shaft.

2. The scroll-type hydraulic machine as claimed in claim 1, wherein each of said first and second eccentric ring mechanisms comprises an eccentric ring, eccentric ring bearing means for supporting said eccentric ring rotatably with respect to said eccentric shaft, and orbiting scroll bearing means for supporting said eccentric ring rotatably with respect to said orbiting scroll shaft.

3. The scroll-type hydraulic machine as claimed in claim 2, wherein said crank mechanism is arranged such that, relative to a center of rotation of said crankshaft, a center of rotation of either of said first and second orbiting scroll shafts and a center of rotation of either of said eccentric rings fall along a straight line, and a distance between said center of rotation of said crankshaft and said center of rotation of said orbiting scroll shaft are substantially equal to a crank radius.

4. The scroll-type hydraulic machine as claimed in claim 3, further including coupling means provided with a first pair of projections on a side thereof disposed toward said eccentric shaft and a second pair of projections on the opposite side thereof, said first pair of projections being slidably supported in a housing of said machine, and said second pair of projections being slidably engaged in respective slots formed in a respective one of said orbiting scrolls.

5. The scroll-type hydraulic machine of claim 1, further comprising a gear provided within a housing of said machine rotatably engaged with said crankshaft, said gear having a shaft attached thereto extending outside of said housing.

6. The scroll-type hydraulic machine as claimed in claim 5, further comprising an oil tank provided below said gear, and a pump for supplying oil from said tank through oil flow passageways formed in said housing and in said gear shaft for supplying lubricating oil to sliding components of said machine.

7. A composite scroll-type hydraulic machine, comprising:

a plurality of scroll-type hydraulic machines as claimed in any one of claims 1 to 6;

a single drive gear engaged with each crankshaft of each of said scroll-type hydraulic machines, said scroll-type hydraulic machines being arranged parallel to one another equiangularly around said gear; and means for rotating said gear.

8. A scroll-type hydraulic machine, comprising:

a first stationary scroll having a first scroll wrap;

a first orbiting scroll having on one surface thereof a second scroll wrap and on the other surface a first connecting means, said second scroll wrap being interleaved with said first scroll wrap so that, when said second scroll wrap orbits with respect to said first scroll wrap, fluid introduced between said scroll wraps is changed in volume;

a second stationary scroll having a third scroll wrap;

a second orbiting scroll having on one surface thereof a fourth scroll wrap and on the other surface a second connecting means, said fourth scroll wrap being interleaved with said third scroll wrap so that, when said fourth scroll wrap orbits with respect to said third scroll wrap, fluid introduced between said third and fourth scroll wraps is changed in volume;

a rotatably driven crankshaft common to said first and second orbiting scrolls and having a first eccentric portion and a second eccentric portion;

a first adjusting means for connecting said first eccentric portion to said first connecting means to adjust an angular relationship between a center ($O_3$) of said first eccentric portion and a center ($O_2$) of said first connecting means so that said second scroll wrap contacts said first scroll wrap; and a second adjusting means for connecting said second eccentric portion to said connecting means to adjust, independently of said first adjusting means, an angular relationship between a center ($O_3$) of said second eccentric portion and a center ($O_2$) of said second connecting means so that said fourth scroll wrap contacts said third scroll wrap each said adjusting means comprising a ring having an eccentrically formed opening therein for the respective connecting means.

9. The scroll-type hydraulic machine as claimed in claim 8, wherein said first adjusting means is disposed between said first connecting means and said first eccentric portion in a radial direction and said second adjusting means is disposed between said second connecting means and said second eccentric portion in a radial direction.

10. The scroll-type hydraulic machine as claimed in claim 9, wherein said first adjusting means is rotatable with respect to said first connecting means and said first eccentric portion, and said second adjusting means is rotatable with respect to said second connecting means and said second eccentric portion.

11. The scroll-type hydraulic machine as claimed in claim 10, further comprising a first bearing disposed between said first connecting means and said first adjusting means, a second bearing disposed between said first eccentric portion and said first adjusting means, a third bearing disposed between said second connecting means and said second adjusting means, and a fourth bearing disposed between said second eccentric portion and said second adjusting means.

12. The scroll-type hydraulic machine as claimed in claim 12, further comprising a first thrust bearing for supporting said first orbiting scroll, said first thrust bearing being disposed such that said first connecting means is enclosed thereby, and a second thrust bearing for supporting said second orbiting scroll, said second thrust bearing being disposed such that said second connecting means is enclosed thereby.

13. The scroll-type hydraulic machine as claimed in claim 12, wherein said first thrust bearing is provided on said first eccentric portion and said second thrust bearing is provided on said second eccentric portion.

14. A scroll-type hydraulic machine, comprising:

a first stationary scroll having a first scroll wrap;

a first orbiting scroll having on one surface thereof a second scroll wrap and on the other surface a first connecting means having a first ring side surface, said second scroll wrap being interleaved with said first scroll wrap so that, when said second scroll wrap orbits with respect to said first scroll wrap, fluid introduced between said scroll wraps is changed in volume;

a second stationary scroll having a third scroll wrap a second orbiting scroll having on one surface thereof a fourth scroll wrap and on the other surface a second connecting means having a second ring side surface, said fourth scroll wrap being interleaved with said third scroll wrap so that, when said fourth scroll wrap orbits with respect to said third scroll wrap, fluid introduced between said third and fourth scroll wraps is changed in volume;

a first ring having an inner surface outside of said first ring side surface;

a second ring having an inner surface outside of said second ring side surface, said inner surface of said first and second rings being respectively eccentric with respect to said outer surfaces thereof; and a rotatably driven crankshaft, common to said first and second orbiting scrolls, said rotatably driven crankshaft having a first eccentric portion having a third ring side surface and a second eccentric portion having a fourth ring side surface, an outer surface of said first ring being inside of said third ring side surface and an outer surface of said second ring being inside of said fourth ring side surface.

15. The scroll-type hydraulic machine as claimed in claim 14, wherein said first ring is rotatable with respect to said first and third ring side surfaces and said second ring is rotatable with respect to said second and fourth ring side surfaces.

16. The scroll-type hydraulic machine as claimed in claim 15, further comprising a first bearing disposed between said first ring and said first ring side surface, a second bearing disposed between said first ring and said third ring side surface, a third bearing disposed between said second ring and said second ring side surface and a fourth bearing disposed between said second ring and said fourth ring side surface.

17. The scroll-type hydraulic machine as claimed in claim 16, further comprising a first thrust bearing disposed outside said first connecting means for supporting said first orbiting scroll, and a second thrust bearing disposed outside said second connecting means for supporting said second orbiting scroll.

18. The scroll-type hydraulic machine as claimed in claim 17, wherein said first thrust bearing is provided on said first eccentric portion and said second thrust bearing is provided on said second eccentric portion.

* * * * *